US009828716B2

(12) United States Patent
Mazzon et al.

(10) Patent No.: US 9,828,716 B2
(45) Date of Patent: Nov. 28, 2017

(54) METHOD FOR CONTROLLING A LAUNDRY WASHING MACHINE AND LAUNDRY WASHING MACHINE

(71) Applicant: Electrolux Home Products Corporation N.V., Brussels (BE)

(72) Inventors: Andrea Mazzon, Sacile (IT); Alberto Lucchetta, Pordenone (IT); Joseph Migeot, Watigny (FR); Mustapha Taffahi, Les Ayvelles (FR)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 14/653,923

(22) PCT Filed: Dec. 16, 2013

(86) PCT No.: PCT/EP2013/076750
§ 371 (c)(1),
(2) Date: Jun. 19, 2015

(87) PCT Pub. No.: WO2014/095752
PCT Pub. Date: Jun. 26, 2014

(65) Prior Publication Data

US 2015/0337477 A1 Nov. 26, 2015

(30) Foreign Application Priority Data

Dec. 21, 2012 (EP) ..... 12198827

(51) Int. Cl.
*D06F 33/00* (2006.01)
*D06F 35/00* (2006.01)
*D06F 33/02* (2006.01)

(52) U.S. Cl.
CPC ..... *D06F 35/005* (2013.01); *D06F 33/02* (2013.01); *D06F 2202/10* (2013.01);
(Continued)

(58) Field of Classification Search
CPC ..... D06F 33/02; D06F 37/203; D06F 39/003; D06F 35/006
(Continued)

(56) References Cited

U.S. PATENT DOCUMENTS

| | | | | |
|---|---|---|---|---|
| 7,376,998 | B2 * | 5/2008 | Seo | D06F 35/007 68/12.06 |
| 8,245,343 | B2 * | 8/2012 | Park | D06F 35/006 8/158 |
| 2010/0154133 | A1 * | 6/2010 | Choi | D06F 17/08 8/159 |

FOREIGN PATENT DOCUMENTS

| | | |
|---|---|---|
| EP | 0268155 A2 | 5/1988 |
| EP | 0407272 A1 | 1/1991 |
| EP | 2050856 A1 | 4/2009 |

OTHER PUBLICATIONS

International Search Report dated Mar. 27, 2014 in corresponding International Application No. PCT/EP2013/076750.

* cited by examiner

*Primary Examiner* — Michael Barr
*Assistant Examiner* — Thomas Bucci
(74) *Attorney, Agent, or Firm* — Banner & Witcoff, Ltd.

(57) ABSTRACT

A method controls a laundry washing machine (1) including: a casing (2), a washing tub (3) arranged within the casing (2), a rotatable laundry drum (4) which is mounted inside the washing tub (3) and is designed to contain laundry (10), a water-detergent supply system (5,6) designed to supply wash water and detergent into the washing tub (3), and a motor assembly to rotate the laundry drum (4). The method includes the steps of: performing a wash phase, in which a predetermined intermediate spin is performed in a standard way, or skipped, or performed in a modified way, based on one or more detected phase conditions; performing at least
(Continued)

a rinse phase, in which a predetermined intermediate spin is performed in a standard way, or skipped, or performed in a modified way, based on one or more detected phase conditions; performing a detection of whether, in a previous wash phase or rinse phase, a predetermined intermediate spin was performed in a standard way, or skipped, or performed in a modified way and, based on the detection, performing a following rinse phase adapted to said detection and/or adding a rinse phase to be performed.

18 Claims, 3 Drawing Sheets

(52) U.S. Cl.
CPC ..... *D06F 2202/12* (2013.01); *D06F 2204/08* (2013.01); *D06F 2222/00* (2013.01); *D06F 2232/06* (2013.01)

(58) Field of Classification Search
USPC ..... 68/12.01, 12.06, 12.04, 12.23, 12.05, 68/12.12, 12.19, 12.14, 12.27, 23.1; 8/159, 158, 137
See application file for complete search history.

METHOD FOR CONTROLLING A LAUNDRY WASHING MACHINE AND LAUNDRY WASHING MACHINE

The present invention concerns the field of laundry washing techniques.

In particular, the present invention refers to a method for controlling a laundry washing machine during the rinsing phase and to a laundry washing machine implementing this method.

BACKGROUND ART

Nowadays the use of laundry washing machines, both "simple" laundry washing machines (i.e. laundry washing machines which can only wash and rinse laundry) and laundry washing and drying machines (i.e. laundry washing machines which can also dry laundry), is widespread.

In the present description the term "laundry washing machine" will refer to both simple laundry washing machines and laundry washing and drying machines.

In addition, in the present description when reference is made to "water", the term "water" may denote water as such, washing water, washing liquid, washing liquor or the like.

As it is known, a laundry washing machine comprises a water tub to receive water and a cylindrical rotary drum rotatably mounted in the water tub to receive laundry, which washes the laundry by lifting and dropping the laundry in the rotary drum along the inner surface of the rotary drum during the rotation of the rotary drum.

During a wash phase, the laundry washing machine determines the amount of wash water and rinse water according to a user's selection of a washing course, supplies water such as wash water having an amount sufficient to wash the laundry, supplies detergent into the water tub according to the determined amount of wash water, and performs washing operations while detergent and water are forwarded to the laundry and the laundry is dropped by the rotation of the rotary drum.

At the end of the wash phase, the laundry washing machine generally performs one or more washing intermediate spins wherein the drum is rotated at a high speed one or more times for extracting washing water from the laundry; during and/or after these washing intermediate spins water is drained from the washing tub by activating a draining pump.

Afterwards the washing machine starts the rising phase wherein supplies water having an amount sufficient to rinse the laundry into the water tub according to the determined amount of rinse water, and performs a rinsing operation while water is brought into contact with the laundry and the laundry is dropped by the rotation of the rotary drum.

At the end of the rinse phase, the laundry washing machine performs one or more rinsing intermediate spins, substantially in the same manner as the above described washing operation, and the drainage of the dirty water.

Generally, laundry washing machine comprises an electronic control system which is configured to perform or alternately skip the intermediate spins during the wash or rinse phases, based on the results of preset machine checks that electronic control system performs before implementing intermediate spins.

In detail, electronic control system is usually configured to skip washing or rinsing intermediate spins, when it detects, immediately before implementing spins, that laundry load is unbalanced and/or high quantity of foam is formed in the rotary drum.

Tests made by the applicant proved that intermediate spins are most skipped with full laundry loads and/or sponge laundries and that skipping intermediate spins causes high quantity of dirty water to remain inside the laundry.

Accordingly, if washing or rinsing intermediate spins are skipped, there is the risk that dirty washing/rinsing liquid is not effectively removed from the laundry before the following rinsing phase, which can worsen the rinsing performances of the following rinsing step.

The applicant conducted an in-depth study with the objective of identifying a solution which specifically allows keeping constant the rinse performance of the cycle even if intermediate spin are skipped or modified.

It is thus the object of the present invention to provide a solution which allows achieving the objective indicated above.

SUMMARY OF SELECTED INVENTIVE ASPECTS

Applicant has found that by detecting (or sensing) if, in a previous washing or rinsing phase, an intermediate spin has was performed in a standard way, or was skipped, or was performed in a modified way and, based on this detection (or sensing), performing a following rinse phase adapted to this detection (or sensing), and/or adding a rinse phase to be performed, it is possible obtaining always high rinsing performances even if intermediate spins are skipped or modified, for example due to an unbalance condition, or to the presence of too much foam.

According to an aspect of the present invention, there is provided a method for controlling a laundry washing machine comprising: a casing, a washing tub arranged within the casing, a rotatable laundry drum which is mounted inside the washing tub and is designed to contain laundry, a water-detergent supply system designed to supply wash water and detergent into the washing tub, and a motor assembly to rotate the laundry drum; the method comprising the step of: performing a wash phase in which a predetermined intermediate spin is performed in a standard way, or skipped, or performed in a modified way, based on one or more detected phase conditions; performing a rinse phase in which a predetermined intermediate spin is performed in a standard way, or skipped, or performed in a modified way, based on one or more detected phase conditions; performing a detection of whether, in a previous wash phase or rinse phase, a predetermined intermediate spin was performed in a standard way, or skipped, or performed in a modified way and, based on this detection (i.e. the detection of whether, in a previous wash phase or rinse phase, a predetermined intermediate spin was performed in a standard way or skipped or performed in a modified way), performing a following rinse phase adapted to this detection (i.e. the detection of whether, in a previous wash phase or rinse phase, a predetermined intermediate spin was performed in a standard way or skipped or performed in a modified way), and/or adding a rinse phase to be performed.

It is underlined that in the present application, performing the predetermined intermediate spin in a "standard" way means that the parameters of the spin (e.g. rotation speed, acceleration, direction of rotation, etc.) depend on set washing program and are not modified as a function of the phase conditions (e.g. degree of unbalance, quantity of foam, etc.) detected during the previous washing or rinsing phase; performing the predetermined intermediate spin in a "modified" way means that the parameters of the spin (e.g. rotation speed, acceleration, direction of rotation, etc.) are modified, with respect to their value when the intermediate spin is performed in a "standard" way, in dependence of the wash phase conditions detected in the previous washing or rinsing phase.

Preferably, the method comprises the step of increasing the predetermined amount of water to be supplied in the drum of a prefixed quantity of water, if in a previous wash phase or rinse phase, the predetermined intermediate spin was skipped and/or if the predetermined intermediate spin was performed in a modified way.

Due to the modification of the last intermediate spin, a higher amount of dirty washing/rinsing liquid remains in the laundry; by supplying an increased amount of clean water, this higher amount of water remaining in the laundry is more diluted by this clean water, which improves the rinsing performances.

Preferably, the washing program comprises one or more predetermined rinse phases to be performed; the method comprising the step of adding a rinse phase to the washing program if, in a previous wash phase or rinse phase, the predetermined intermediate spin was skipped and/or if the predetermined intermediate spin was performed in a modified way.

Preferably, the one or more detected phase conditions comprise a laundry unbalance condition; the method comprising the step of detecting the laundry unbalanced condition before performing the predetermined intermediate spin in a standard way, and/or before skipping the predetermined intermediate spin, and/or before performing the predetermined intermediate spin in a modified way.

Preferably, performing the predetermined intermediate spin in a modified way comprises the step of decreasing the speed of the predetermined intermediate spin based on the detected laundry unbalanced condition.

Preferably, the predetermined intermediated spin is skipped if the laundry unbalance detected before skipping the predetermined intermediate spin, exceeds a predetermined threshold.

Preferably, the one or more phase conditions comprise a high foam amount condition which is detected if the amount of foam detected in the drum exceeds a predetermined quantity threshold.

Preferably, the predetermined intermediated spin is skipped if the amount of foam detected in the drum exceeds a predetermined quantity threshold.

Preferably, the predetermined intermediated spin to be performed in a standard way, or to be skipped, or to be performed in a modified way, is provided at the end of the wash phase and/or at the end of the rinse phase.

Preferably, the prefixed quantity of water is comprised from about 3 liters to about 5 liters.

Preferably, the prefixed intermediate spin comprises a rotational drum speed which is higher than 600 RPM.

The present invention further relates to a laundry washing machine comprising a casing, a washing tub arranged within the casing, a rotatable laundry drum which is mounted inside the washing tub and is designed to contain laundry, an electric assembly structured to rotate the laundry drum, water/detergent a supply system designed to supply wash water and/or detergent into the washing tub and a motor assembly to rotate the laundry drum; and a control unit configured to: perform a wash phase in which a predetermined intermediate spin is performed in a standard way, or skipped, or performed in a modified way, based on one or more detected phase conditions; perform at least a rinse phase in which a predetermined intermediate spin is performed in a standard way, or skipped, or performed in a modified way, based on one or more detected phase conditions; performing a detection of whether, in a previous wash phase or rinse phase, a predetermined intermediate spin was performed in a standard way or skipped or performed in a modified way and, based on this detection, perform a following rinse phase adapted to the detection and/or adding a rinse phase to be performed.

Preferably, the control unit is further configured to control the water/detergent supply system to supply a predetermined amount of water in the drum during each rinse phase, the control unit being further configured to increase the predetermined amount of water to be supplied in the drum of a prefixed quantity of water if in a previous wash phase or rinse phase, a predetermined intermediate spin was skipped and/or if a predetermined intermediate spin was performed in a modified way.

Preferably, the control unit is further configured to perform one or more predetermined rinse phases, and adding a rinse phase to the washing program if in a previous wash phase or rinse phase the predetermined intermediate spin was skipped and/or if the predetermined intermediate spin was performed in a modified way.

Preferably, the control unit is further configured to control the motor assembly to decrease the speed of the intermediate spin based on the detected laundry unbalanced condition.

BRIEF DESCRIPTION OF THE DRAWINGS

Further characteristics and advantages of the present invention will be highlighted in greater detail in the following detailed description of some of its preferred embodiments, provided with reference to the enclosed drawings. In the drawings, corresponding characteristics and/or components are identified by the same reference numbers. In particular.

DETAILED DESCRIPTION OF EXAMPLE EMBODIMENTS

The method of the present invention has proved to be particularly advantageous when applied to laundry washing machines, as described below. It should in any case be underlined that the present invention is not limited to this type of application. On the contrary, the present invention can be conveniently applied to other equipments, like for example laundry washing and drying machines (called also washer/driers), wherein one or more steps of introducing water inside a washing tub is required.

Figure 1:
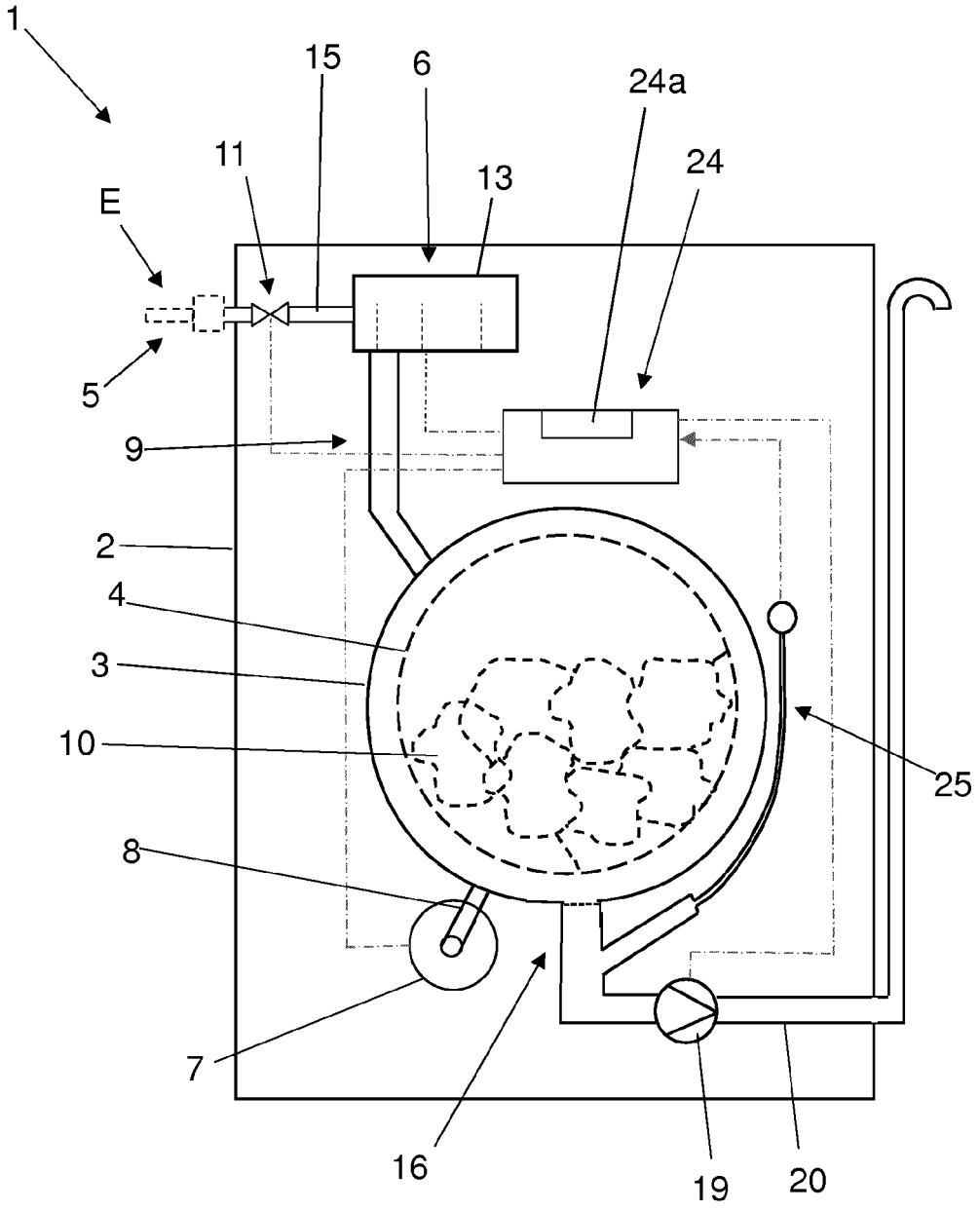
FIG. 1 shows schematically a front view of a laundry washing machine implementing the control method according to the invention.

With reference to FIG. 1, a laundry washing machine 1 according to the invention is described, in which a control method of the invention is implemented.

The laundry washing machine 1 is a front loading laundry washing machine. The present invention has proved to be particularly successful when applied to front loading laundry washing machines. It should in any case be underlined that the present invention is not limited to this type of application. On the contrary, the present invention can be usefully applied to different types of loading washing devices, for example top loading laundry washing machines or top loading laundry washing and drying machines.

The laundry washing machine 1 comprises an external casing or casing 2, in which a washing tub 3 is provided that contains a rotatable perforated drum 4, where the laundry 10 to be washed can be loaded. The washing tub 3 and the drum 4 both have preferably a substantially cylindrical shape. The casing 2 is provided with a loading/unloading door (not illustrated) which allows access to the washing tub 3 and the drum 4. The washing tub 3 is preferably suspended in a floating manner inside the casing 2, advantageously by means of a number of coil springs and shock-absorbers (not illustrated). The drum 4 is advantageously rotated by an electric motor 7, which preferably transmits the rotating motion to the shaft of the drum 4, advantageously by means of a belt/pulley system 8. In a different embodiment of the invention, the motor can be directly associated with the shaft of the drum 4.

A water supply system 5 and a detergent supply system 6 are arranged preferably in the upper part of the laundry washing machine 1 and are structured to supply water and washing/rinsing products, i.e. detergent, softener, etc., into the washing tub 3.

The detergent supply system 6 advantageously comprises a, preferably removable, drawer 13 provided with various compartments designed to be filled with washing and/or rinsing products.

In the embodiment herein described, the water flowing through the water supply system 5 is advantageously supplied into the washing tub 3 by making it flow through the drawer 13 and through a supply pipe 9 which extends toward the tub 3. The supply pipe output of the supply pipe 9 advantageously ends in correspondence of the tub 3. Preferably the supply pipe output ends in correspondence of a lateral side of the tub 3, as shown in the example of FIG. 1; alternatively the supply pipe output of the supply pipe 9 may advantageously end in correspondence of the bellows (not illustrated) connecting the loading/unloading openings of the tub and of the casing. The water supply system 5 further comprises a main pipe 15 which opportunely connects the drawer 13 to an external water supply line E, preferably by means of a controlled supply valve 11.

In a preferred embodiment, the water which reaches the washing tub 3 can selectively contain one of the products contained in the compartments of the drawer 13, or such water can be clean (i.e. without products), depending on the phase of the washing program which is actually performed; in the initial phases of the washing program, for example, the detergent is conveyed into the tub 3 by the incoming water, while in other phases, for example during the rinsing phase, only water is conveyed into the tub 3.

In an alternative embodiment of the invention, a further separate water supply pipe can be provided, which supplies exclusively clean water into the tub 3.

The laundry washing machine 1 further comprises a water draining system 16 which is structured to drain the wash water, i.e. dirty water or water mixed with washing and/or rinsing products, from the washing tub 3 to the outside.

The water draining system 16 advantageously comprises the bottom region of the tub 3, which is provided with a liquid outlet fluidly connected to a draining pump 19 arranged to remove liquid from the tub 3 and to take this liquid into a draining suction pipe 20 having an end fluidly connected to the draining pump 19, and the other end designed to be fluidly connected to a house draining pipe system (not illustrated).

The laundry washing machine 1 may be advantageously provided with one or more liquid level sensor device 25 (schematically illustrated in FIG. 1) designed to sense or detect the liquid level inside the tub 3. The sensor device 25 may preferably comprise a pressure sensor which senses the pressure in the tub 3. From the pressure values sensed by the sensor device 25 it is possible to detect (or sense) the water level of the wash water and/or the foam level contained in the tub 3. According to a preferred embodiment of the invention the pressure sensor may be fluidly connected with a draining sump of the water draining system 16.

The sensor device 25 may preferably comprise in addition to or as a replacement of the pressure sensor, a level sensor, for example mechanical, electro-mechanical, optical, etc., configured to sense or detect the water level inside the tub 3.

A control unit 24 is advantageously connected to the various parts of the laundry washing machine 1 in order to ensure its operation. The control unit 24 is preferably operatively connected to: the electric motor 7 so that the drum speed may be controlled, the controlled supply valve 11 so that the water supplied to the drawer 13 is controlled; and to the draining pump 19 to control the draining of liquid from the tub 3.

The control unit 24 is further preferably operatively connected to the level sensor device 25 to receive information about sensed water level, and is configured to (detect or sense) the foam level inside of tub 3 based on sensed water level.

The control unit 24 is operatively connected also to an interface unit 24*a* (only schematically illustrated in FIG. 1) which is accessible to the user and by means of which the user selects and sets the washing parameters, for example the desired washing program. Advantageously, other parameters can optionally be inserted by the user, for example the washing temperature, the spinning speed, the load in terms of weight of the laundry to be washed, the type of fabric of the load, etc.

The interface unit 24*a* also preferably comprises a display where some pieces of information are opportunely displayed.

Preferably based on the parameters acquired by said interface unit 24*a*, the control unit 24 sets and controls the various parts of the laundry washing machine 1 in order to carry out the desired washing program.

Preferably, the control unit 24 is configured to set: time and rotation speed of the intermediate spin to be performed at the end of the wash phase, and/or the number of rinse phase to be performed during the washing program, the amount of water to be supplied in the tub 3 during rinse phases; and/or the number of intermediate spins to be performed at the end of each rinse phase.

Preferably the control unit 24 is further configured to perform unbalance laundry checks to verify whether the laundry 10 loaded in the drum 4 is balanced or not. To this end, the control unit 24 may be configured to perform a known unbalance control procedure such as, for example, procedure disclosed in EP 2 050 856.

A preferred embodiment of the method for controlling the laundry washing machine 1 according to the invention is described here below with reference to the laundry washing machine 1 shown in FIG. 1 and with reference to the flow charts illustrated in FIGS. 2 and 3.

During the washing program, the laundry washing machine 1 will sequentially proceed through a main wash phase (step 200), one or more predetermined rinse phases (step 400) and at least one final spin phases (600).

The laundry washing machine 1 is advantageously configured to be able to perform: at least an intermediate spin at the end of the main wash phase and before the beginning of the rinse phase/s, and at least an intermediate spin at the end of each rinse phase and before the beginning of a possible next rinse phase, in order to extract from the laundry as much washing liquid as possible.

In order to perform the intermediate spin, the method rotates the drum 4 at a preset high speed higher than the mean speed during a "normal" wash phase (which is typically around 30-60 RPM). According to the present invention the high rotational speed of the intermediate spin is preferably higher than 600 RPM, and preferably comprised from about 650 RPM to about 1200 RPM.

Figure 2:
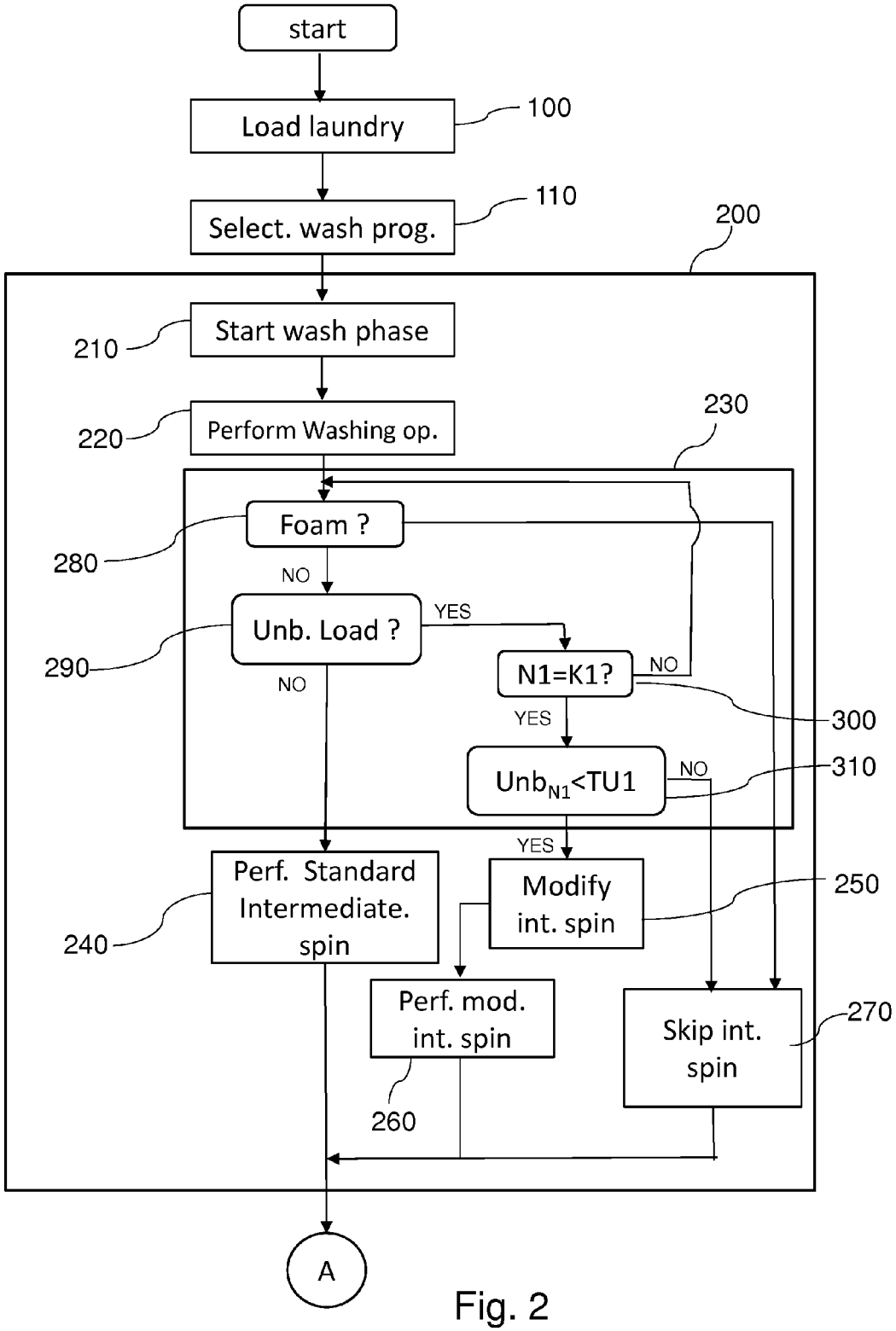
FIG. 2 is a first part of flow chart of the basic operations of the method for controlling the washing machine of FIG. 1.
Figure 3:
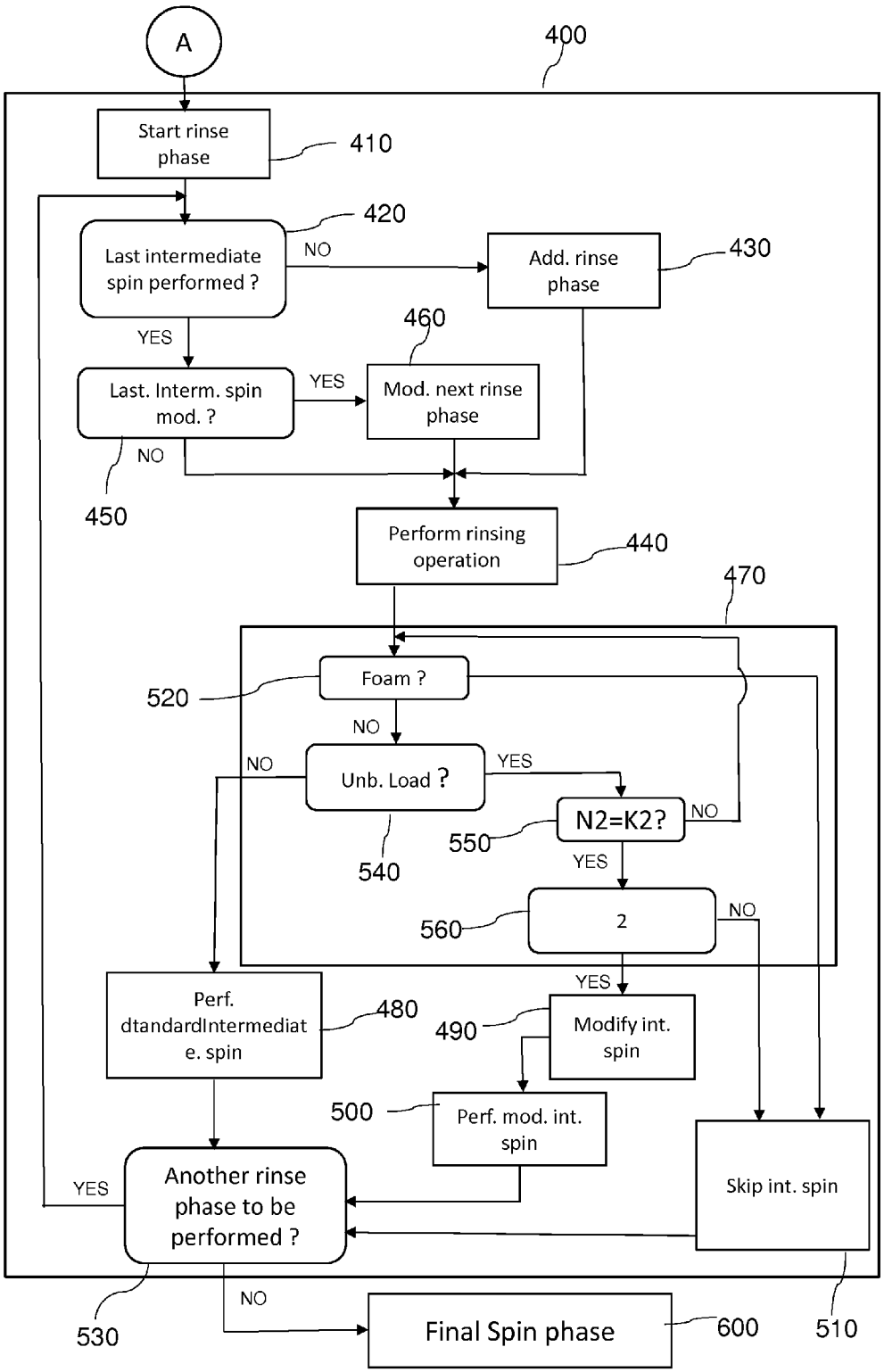
FIG. 3 is a second part of flow chart of the basic operations of the method for controlling the washing machine of FIG. 1.

Referring to FIG. 2, the method for controlling the laundry washing machine 1 according to a preferred embodiment of the present invention comprises a step 100 wherein the laundry 10 to be washed is first placed inside the drum 4; preferably a step 110 wherein a desired washing program is selected by the user, and the step 200 in which the method starts the main wash phase (step 210) based on the selected washing program.

Clearly step 110 may be performed as well before step 100.

In a further advantageous embodiment, not illustrated, step 110 may be replaced by a step in which the machine automatically selects, for example among a set of memorized washing programs, the washing program best fittings with the specific characteristics (e.g. material, dirty degree, weight) of the loaded laundry; these characteristics which may be detected by the machine (for example by specific sensors), and/or set by the user for example by the interface unit 24*a*.

Referring to FIG. 2, the method performs washing operations (step 220), in which the control unit 24 may start a water/detergent loading phase, wherein preset amounts of water and detergent/s are loaded into the tub 3 so as to get a wash solution inside the latter. In an advantageous embodiment, during such starting water-detergent loading phase, the control unit 24 preferably controls the supply valve 11 based on the water level sensed by the sensor device 25 so that a preset amount/level of water is reached in the tub 3.

Moreover, the control unit 24 preferably further controls detergent supply system 6 so that a prefixed amount of detergent is loaded in the tub 3.

After, or also during, the water-detergent loading phase, the drum 4 is rotated in order to cause the laundry 10 to tumble through the washing solution.

Preferably the tumbling movement may be performed after the end of the detergent loading phase, but in a further embodiment the tumbling movement may be performed also during the water/detergent loading phase. In a further advantageous embodiment, the tumbling movement phase may be performed both during and after the water/detergent loading phase. In a further advantageous embodiment, the tumbling movement phase may be performed before, during and after the water/detergent loading phase.

Preferably, the tumbling movement may be performed by rotating the drum 4 at a low wash speed, e.g. about 40-50 RPM. Advantageously this low wash speed is a speed lower than the speed, typically around 100 RPM, at which the liquid collected inside the tub forms a continuous liquid ring circulating along the inner surface of the tub; advantageously at this low speed the laundry loaded in the drum is not completely stuck (i.e. fixed) to the lateral surface of the drum, and therefore at least part of the laundry (depending on how much laundry is loaded) can tumble (i.e. rotate) inside the drum 3.

During the washing operations the method further drains the wash water, i.e. dirty water or water mixed with washing products, from the washing tub 3 to the outside. Preferably, the method may control the draining pump 19 and drainage valves (not illustrated) to drain the wash water in the washing tub 3 to the outside through the draining pipe 20.

After the completion of washing operations, the method performs a predetermined intermediate spin in a standard way, or skips the predetermined intermediate spin, or performs the intermediate spin in a modified way based on detected wash phase conditions.

It is underlined that performing the predetermined intermediate spin in a "standard" way means that the parameters of the spin (e.g. rotation speed, acceleration, direction of rotation, etc.) depend on set washing program and are not modified as a function of the phase conditions (e.g. degree of unbalance, quantity of foam, etc.) detected during the previous washing or rinsing phase.

On the other side, performing the predetermined intermediate spin in a "modified" way means that the parameters of the spin (e.g. rotation speed, acceleration, direction of rotation, etc.) are modified, with respect to their value when the intermediate spin is performed in a "standard" way, in dependence of the wash phase conditions detected in the previous washing or rinsing phase. Preferably the method determines/checks whether at least one wash intermediate spin can be performed at the end of the wash phase (step 230) for extracting the water from the laundry.

Preferably, the intermediate spin of the wash phase can be performed based on the absence/presence of foam inside of the drum 3 and/on the unbalance stage/level of the laundry loaded in the drum 3.

According to results of the check, the method may alternately performs the step of: performing the intermediate spin (step 240) in a standard way based on the predetermined intermediate spin set in the washing program, or adapting/modifying the intermediate spin (step 250) and performing the modified intermediate spin (step 260), or skipping the intermediate spin (step 270).

Preferably, during the check step, the method may detect whether the amount of foam inside the drum has reached a predetermined quantity threshold (step 280).

Preferably, the method may detect whether the amount of foam (formed during the wash operations) has reached the predetermined quantity threshold, based on the water level sensed by means of the sensor 25. A phase condition may comprise a high foam amount condition which is determined if the amount of foam detected in the drum 3 exceeds a predetermined quantity threshold.

Preferably, if the amount of foam contained in the drum 3 is greater or equal than the predetermined quantity threshold, the method determines that wash intermediate spin cannot be performed. In this case, the method preferably skips the intermediate spin (e.g. do not perform the intermediate spin) at the end of the wash phase (step 270) and starts to perform the rinse phase (steps 400, 410).

On the other hand, if the amount of the detected foam is lower than said predetermined quantity threshold, the method may preferably perform an unbalance check, wherein it is detected whether the laundry load is unbalanced or not (a laundry unbalance condition). Preferably, a detected phase conditions comprise a laundry unbalance condition.

The unbalance check may be advantageously provided even if the step of detecting whether the amount of foam inside the drum has reached a predetermined quantity threshold (step 280) would be not provided.

If the laundry load is unbalanced—laundry unbalance condition is detected—(Yes output from step 290), the method may preferably perform the foam check again (step 280), and if the detected foam is lower than predetermined quantity threshold, a new unbalance check (step 290) may be performed. Preferably, the method performs the foam check and the next unbalance check a prefixed number of times K1 (K1 may be also null, i.e. the method may not perform this further foam check and next unbalance check). To this end, the method may increment a counter N1 during each foam/unbalance check, and stops the checks when counter N1 reaches the prefixed number K1 (output Yes from step 300).

It should be pointed out that, if during one of the checks the method determines that amount of detected foam exceeds the predetermined quantity threshold, than it determines that intermediate spin cannot be performed, and step 270 is implemented.

If during the checks, the method determines that laundry load is balanced (output No from step 290) (and preferably that the amount of foam is lower than said predetermined quantity threshold), the method performs the intermediate spin in a standard way based on the prefixed intermediate spin, e.g. spin set in the selected washing program (step 240).

On the other hand, if the number N1 of unbalance checks reaches the prefixed number K1 (and, preferably, if the amount of foam is lower than the predetermined quantity threshold), the method stops the check and verifies whether the unbalance level detected in the last check ($Unb_{N1}$) is lower than a first level threshold TU1 (step 310).

If the unbalance level $Unb_{N1}$ detected during the last check is greater than, or equal to, the first level threshold TU1, the method determines that intermediate spin cannot be performed. In such a case, the method advantageously skips the intermediate spin (e.g. do not perform the intermediate spin) at the end of the washing phase (step 270) and starts to performs the rinse phase (steps 400, 410).

On the other hand, if the unbalance level $Unb_{N1}$ (preferably expressed in kilos) detected during the last check is lower than the level threshold TU1 (output Yes from step 310), the method preferably modifies the predetermined intermediate spin (step 250) (i.e. performs the predetermined intermediate spin in a modified way). Preferably, the method decreases the speed of the intermediate spin from a prefixed rotation speed (of the set intermediate spin) to a lower speed, based on the detected unbalance level. In such case, the method performs the modified intermediate spin according to the modified speed (step 260).

It should be pointed out that during and/or after the intermediate spin, the method may preferably control the draining pump 19 to drain the wash water extracted from the laundry 10 to the outside.

After the completion of wash phase, the method starts to perform the first rinse phase (step 410) and preferably, although not necessarily, verifies whether the last intermediate spin was performed (step 420).

It should be pointed out that if the method is starting the first rinse phase according to the selected washing program, the last intermediate spin corresponds to the intermediate spin performed in the washing phase, whereas if the method is starting the second or following rinse phases, the last intermediate spin corresponds to the intermediate spin of the previous rinse phase that method has performed.

Preferably, if the previous intermediate spin has not been performed (i.e. skipped) (No output from step 420), the method preferably adds at least one rinse phase to the rinse phase/s set/established in the selected washing program (step 430) and starts to perform the rinsing operations of the current rinse phase set in the washing program (step 440).

On the other hand, if the last intermediate spin was performed, the method checks whether the last intermediate spin was modified (e.g. the rotation speed was decreased) (step 450).

If the last intermediate spin was modified, the method makes modifications on the rinsing operations to be performed (step 460). Preferably, in such case, the method modifies the quantity of water to be supplied to the drum 4 during the present rinse phase. Preferably, the method increases of a prefixed quantity the amount of water to be supplied to the drum 4 during the rinse phase. Preferably, the prefixed amount of water that method increases is from about 3 liters to about 5 liters. In such a case, the method performs the rinsing operations (step 440) by supplying to the drum 4 the amount of water modified according to the step 460.

Due to the modification of the last intermediate spin, a higher amount of dirty washing/rinsing liquid remains in the laundry; by supplying an increased amount of clean water, this higher amount of water remaining in the laundry is more diluted by this clean water, which improves the rinsing performances.

Advantageously, also in case the previous intermediate spin has not been performed (i.e. skipped) (No output from step 420), the method may advantageously make modifications on the rinsing operations to be performed. Preferably, also in such case the method may modify the quantity of water to be supplied to the drum 4 during the present rinse phase. Also in this case, preferably, the method increases of a prefixed quantity the amount of water to be supplied to the drum 4 during the rinse phase. Preferably, the prefixed amount of water that method increases, may be from about 3 liters to about 5 liters. In such a case, the method advantageously performs the rinsing operations by supplying to the drum 4 the amount of water modified according to the above step.

If the previous intermediate spin has not been modified (No output from step 450), the method perform the rinsing operations based on the set rinse phase of the washing program (step 440).

During the rinsing operations, the method advantageously performs the steps of command the water supply valve 11 to supply the amount of rinse water for rinsing according to the prefixed amount of water or the modified amount of water (in step 450).

The method further perform the step of operating the electric motor 7 at a predetermined motor RPM and operation rate of the drum 4 such that the laundry 10 is rinsed by the rinse water supplied into the tub 3. As the rotary drum 4 is rotated, the rinse water is brought into contact with the laundry such that detergent/water contained in the laundry is separate from the latter.

During and/or after the rinsing operations, the method further preferably drains the rinse water from the washing tub 3 to the outside. Preferably, the method may control the draining pump 19 and drainage valves (not illustrated) to drain the rinse water in the washing tub 3 to the outside through the draining pipe 20.

When it is detected that the rinsing operations are concluded, the method may check (step 470) whether an intermediate spin can be performed at the end of the current rinse phase.

Preferably, the intermediate spin of the rinse phase can be performed based on the absence/presence of foam inside of the drum 3 and/on the unbalance stage/level of the laundry loaded in the drum 3.

According to results of the check, the method may alternately implements the step of: performing the rinse intermediate spin (step 480) based on the predetermined intermediate spin of the rinse phase set in the washing program, or modifying the rinse intermediate spin of the rinse phase (step 490) and performing the modified intermediate spin (step 500), or skipping the intermediate spin of the rinse phase (step 510).

Preferably, during such check step, the method may detect whether the amount of foam formed inside the drum during the rinsing operations has reached a prefixed threshold (step 520). Preferably, the method may detect whether the amount of foam (formed during the rinsing operations) has reached the prefixed foam threshold, based on the water level sensed by means of the sensor 25.

If the amount of foam contained in the drum 3 is greater or equal than the prefixed foam quantity threshold, the method advantageously skips the intermediate spin (e.g. do not perform the intermediate spin) at the end of the present rinse phase (step 510) and verifies whether a next rinse phase has to be performed (step 530). If a next rinse step has to be performed (Yes output form step 530) (e.g. because the washing program comprises a number of rinse phase, or in step 430, a rinse phase has added) the methods performs again the step 420 and implements the next phases.

On the other hand, if there are not any rinse step to be performed (No output form step 530) the method advantageously starts the final spin phase (step 600).

If the amount of foam is lower than the prefixed foam threshold, the method performs an unbalance check, wherein it is detected whether the laundry load is unbalanced or not (step 540).

If the laundry load is unbalanced (Yes output from step 540), the method may preferably perform the foam check again (step 520), and if the detected foam is lower than prefixed foam quantity threshold, a new unbalance check (step 540) may be performed. Preferably, the method performs the foam check and the next unbalance check a prefixed number of times K2. To this end, the method may increment a counter N2 during each foam/unbalance check, and stops the checks when counter N2 reaches the prefixed number K2 (output Yes from step 550).

It should be pointed out that, if during one of the checks it is detected that the amount of foam exceeds the prefixed foam quantity threshold, the method advantageously provides that intermediate spin cannot be performed, and step 510 is implemented.

If during the checks, the method verifies that laundry load is balanced (output No from step 540) (and the amount of foam is lower than prefixed foam threshold), the method performs the intermediate spin based on the prefixed intermediate spin, e.g. spin set in the selected washing program (step 480).

On the other hand, if the number N2 of unbalance checks reaches the prefixed number K2 (and the amount of foam is lower than prefixed foam threshold), the method advantageously stops the check and checks whether the unbalance level detected in the last check ($Unb_{N2}$) is lower than a second level threshold TU2 (step 560).

If the unbalance level $Unb_{N2}$ detected during the last check is greater than, or equal to, the second level threshold TU2, the method determines that intermediate spin cannot be performed. In such case, the method skips the intermediate spin (e.g. do not perform the intermediate spin) at the end of the rinse phase (step 510) and performs the step 530.

On the other hand, if the unbalance level $UB_{N2}$ (preferably expressed in kilos) detected during the last check is lower than the level threshold TU2 (output Yes from step 560), the method modifies the intermediate spin. Preferably, the method decreases the speed from a prefixed rotation speed (of the set intermediate spin) to a lower speed, based on the detected unbalance level. In such case, the method performs the intermediate spin according to the modified speed (steps 490 and 500) and afterwards, the step 530 is performed.

The method and laundry machine have the major advantage of improving the rinsing performances even if the intermediate spin in the wash or rinse phase is not performed or is performed in a modified way due to unbalanced load or the presence of a high foam quantity in the drum. As a matter of the fact, the increase of the water and/or the addition of the rinse phase that the method performs when the intermediate spin is skipped/modified, has the effect of diluting the dirty water remained in the laundry (due to the absence/modification of the predetermined intermediate spin of the previous washing or rinsing phase) with clean water, causing a improving of rinses performance.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A method for controlling a laundry washing machine comprising: a casing, a washing tub arranged within said casing, a rotatable laundry drum which is mounted inside the washing tub and is designed to contain laundry, a water/detergent supply system designed to supply wash water and/or detergent into the washing tub, and a motor assembly to rotate the laundry drum;

the method comprising:

a) performing a wash phase including:

determining an intermediate wash spin to be performed selected from one of: a standard way, skipped, and a modified way, based on one or more detected wash phase conditions; and based on determining the intermediate wash spin: performing a standard intermediate wash spin, performing a modified intermediate wash spin, or skipping the intermediate wash spin;

b) performing at least a rinse phase including:

determining an intermediate rinse spin to be performed selected from one of: a standard way, skipped, and a modified way, based on one or more detected rinse phase conditions; and based on determining the intermediate rinse spin: performing a standard intermediate rinse spin, performing a modified intermediate rinse spin, or skipping the intermediate rinse spin; and c) performing a following rinse phase including:

performing a detection of a previous intermediate wash spin in a previous wash phase or a previous intermediate rinse spin in a previous wash phase was performed in one of: a standard way, skipped, and a modified way; and based on said detection, performing a rinse phase adapted to said detection and/or adding a rinse phase to be performed.

2. The method according to claim 1, further comprising supplying a predetermined amount of water in the drum during the at least a rinse phase and the following rinse phase, wherein step c) further includes increasing said predetermined amount of water to be supplied in the drum of a prefixed quantity of water, if said previous intermediate wash spin or said previous intermediate rinse spin was skipped and/or if said previous intermediate wash spin or said previous intermediate rinse spin was performed in a modified way.

3. The method according to claim 1, further comprising performing one or more additional rinse phases, wherein step c) further includes adding a rinse phase if said previous intermediate wash spin or said previous intermediate rinse spin was skipped or if said previous intermediate wash spin or said previous intermediate rinse spin was performed in a modified way.

4. The method according to claim 1, wherein said one or more detected wash phase conditions comprise a laundry unbalance condition, said method further comprising the step of detecting said laundry unbalance condition before performing said determined intermediate wash spin.

5. The method according to claim 4, wherein performing said determined intermediate wash spin and in a modified way comprises the step of decreasing a speed of said determined intermediate wash spin based on said detected laundry unbalance condition.

6. The method according to claim 4, wherein said determined intermediate wash spin is skipped if the detected laundry unbalance condition exceeds a predetermined threshold.

7. The method according to claim 1, wherein said one or more wash phase conditions and/or said one or more detected rinse phase conditions comprise a high foam amount condition, which is determined if an amount of foam detected in the drum exceeds a predetermined quantity threshold.

8. The method according to claim 1, wherein the one or more detected wash phase conditions or the one or more detected rinse phase conditions includes an amount of foam in the tub, and wherein an intermediate wash spin and/or an intermediate rinse spin is skipped if the amount of foam detected in the drum exceeds a predetermined quantity threshold.

9. The method according to claim 1, wherein performing said determined intermediate wash spin and/or said determined intermediate rinse spin is provided at an end of said wash phase and/or at an end of said at least a rinse phase.

10. The method according to claim 2, wherein said prefixed quantity of water is in a range of about 3 liters to about 5 liters.

11. The method according to claim 1, wherein said determined intermediate wash spin and/or said determined intermediate rinse spin comprises a rotational drum speed which is higher than 600 RPM.

12. A laundry washing machine comprising: a casing, a washing tub arranged within said casing, a rotatable laundry drum which is mounted inside the washing tub and is designed to contain laundry, an electric assembly structured to rotate said laundry drum, a water/detergent supply system designed to supply wash water and/or detergent into the washing tub and a motor assembly to rotate the laundry drum;

said machine further comprising a control unit configured to:

a) perform a wash phase including:

determining an intermediate wash spin to be performed selected from one of: a standard way, skipped, and a modified way, based on one or more detected wash phase conditions;

based on determining the intermediate wash spin: performing a standard intermediate wash spin, performing a modified intermediate wash spin, or skipping the intermediate wash spin; and b) perform at least a rinse phase including:

determining an intermediate rinse spin to be performed selected from one of: a standard way, skipped, and a modified way, based on one or more detected rinse phase conditions based on determining the intermediate rinse spin: performing a standard intermediate rinse spin, performing a modified intermediate rinse spin, or skipping the intermediate rinse spin; and c) perform a following rinse phase including:

performing a detection of a previous intermediate wash spin in a previous wash phase or a previous intermediate rinse spin in a previous rinse phase was performed in one of: a standard way, skipped, and a modified way; and based on said detection, performing a rinse phase adapted to said detection and/or adding a rinse phase to be performed.

13. The machine according to claim 12, wherein said control unit is further configured to control said water/detergent supply system to supply a predetermined amount of water in the drum during the at least a rinse phase and the following rinse phase, said control unit being further configured to increase said predetermined amount of water to be supplied in the drum of a prefixed quantity of water, if the previous intermediate wash spin or the previous intermediate rinse spin was skipped and/or if the previous intermediate wash spin or the previous intermediate rinse spin was performed in a modified way.

14. The machine according to claim 12, wherein said control unit is further configured to perform one or more additional rinse phases, said control unit being further configured to add an additional rinse phase if the previous intermediate rinse spin was skipped or was performed in a modified way.

15. The machine according to claim 12, wherein the one or more detected wash phase conditions or the one or more detected rinse phase conditions includes a detected laundry unbalance condition, and wherein said control unit is further configured to control said motor assembly to decrease a speed of said determined intermediate wash spin and/or said determined intermediate rinse spin based on the detected laundry unbalance condition.

16. The method according to claim 1, wherein said one or more detected rinse phase conditions comprise a laundry unbalance condition, said method further comprising detecting said laundry unbalance condition before performing said determined intermediate rinse spin.

17. The method according to claim 16, wherein performing said determined intermediate rinse spin in a modified way comprises decreasing a speed of said determined intermediate rinse spin based on said detected laundry unbalance condition.

18. The method according to claim 16, wherein said determined intermediate rinse spin is skipped if the detected laundry unbalance condition exceeds a predetermined threshold.

* * * * *